United States Patent [19]

Milne

[11] 4,240,995

[45] Dec. 23, 1980

[54] METHODS FOR PREPARING NATURAL AND ARTIFICIAL STRUCTURES

[75] Inventor: James Milne, Wigton, England

[73] Assignee: BICC Limited, London, England

[21] Appl. No.: 931,989

[22] Filed: Aug. 8, 1978

[30] Foreign Application Priority Data

Aug. 12, 1977 [GB] United Kingdom ..... 33933/77

[51] Int. Cl.[3] ..... E01C 23/10

[52] U.S. Cl. ..... 264/36; 264/35; 264/102; 264/156; 264/259; 264/263

[58] Field of Search ..... 264/36, 35, 101, 102, 264/571, 154, 156, 261, 263, 267, 259, 155; 404/78

[56] References Cited

U.S. PATENT DOCUMENTS

| | | | |
|---|---|---|---|
| 1,883,196 | 10/1932 | Wertz | 264/36 |
| 1,915,032 | 6/1933 | Poulter | 404/78 |
| 1,929,215 | 10/1933 | Poulter | 404/78 |
| 1,943,914 | 1/1934 | Fiock | 404/78 |
| 2,041,266 | 5/1936 | Poulter | 404/78 |
| 2,125,785 | 8/1938 | Hill, Jr. | 404/78 |
| 2,524,419 | 10/1950 | Billner | 264/36 |
| 4,086,309 | 4/1978 | Alberto | 264/36 |

FOREIGN PATENT DOCUMENTS 1399510 7/1975 United Kingdom .

*Primary Examiner*—James B. Lowe

*Attorney, Agent, or Firm*—Buell, Blenko, Ziesenheim & Beck

[57] ABSTRACT

Voids in at least a part of an artificial or natural structures overlying a highly porous layer (e.g. a concrete road or airfield runway) adjacent an exposed surface of the structure are filled with a hardenable material by forming mutually spaced extractor and injector holes through said part and into said underlying highly porous layer; closely fitting a flexible fluid-impermeable covering over the exposed surface, the covering having adjacent its boundary edges an endless hollow wall that surrounds and opens towards the covered surface, and sealing boundary edges of the covering to the structure to form a substantially fluid-tight enclosure incorporating the hollow wall; evacuating air from the hollow wall and from each extractor hole and introducing hardenable material in a liquid or semi-liquid state into each injector hole; terminating evacuation of air from each extractor hole as hardenable material appears at the outlet of the hole and introducing hardenable material into the hole; and, when hardenable material is being introduced into all injector and extractor holes, gradually bringing evacuation of air to a stop as the hardenable material in the voids sets.

10 Claims, 5 Drawing Figures

METHODS FOR PREPARING NATURAL AND ARTIFICIAL STRUCTURES

This invention relates to artificial and natural structures built up of or comprising a plurality of separately formed bodies of manufactured or natural material or consisting of a single body of concrete or of rock, granite or other material in its natural state. Structures fabricated from or comprising a plurality of separately formed bodies include the walls of buildings, the abutments and piers of bridges, chimneys, brick-lined tunnels, ducts, drains and sewers, retaining walls, foundations, monuments, sculptures, archaeological remains, and other structures built up of or comprising bricks, rocks, stones, granite, timber or other building materials with or without interposed mortar or other hardenable material. Single bodies of concrete or other materials include roads, airfield runways, foundations of heavy machinery, statues and sculptures. All such artificial and natural structures will, for convenience, hereinafter be referred to as "artificial or natural structures of the kind specified."

Where an artificial or natural structure of the kind specified has cracks or voids in at least a part of the structure adjacent an exposed surface of the structure, such as the surface of a road or airfield runway, it has been proposed to introduce a hardenable material in a liquid or semi-liquid state into the cracks or other voids. Where a part of an artificial or natural structure of the kind specified, into cracks and other voids in which hardenable material in a liquid or semi-liquid state is to be introduced, overlies a highly porous layer, for example where concrete slabs of a road overlie a highly porous sub-grade of clinker, there is a risk that the liquefied hardenable material will soak away through the underlying highly porous layer over a wide area with the result that an unnecessarily large amount of hardenable material is required to fill the cracks and other voids, thereby rendering the process expensive, and, in some circumstances, the cracks and other voids are never completely filled.

The present invention provides a method of introducing a hardenable material in a flowable state into cracks or other voids in at least part of an artificial or natural structure adjacent an exposed surface of the structure, which structure overlies a highly porous layer.

According to the present invention, the method comprises drilling or otherwise forming at least one extractor hole through said part and into said underlying highly porous layer in the vicinity of at least one crack or other void into which hardenable material is to be introduced; drilling or otherwise forming at least one injector hole through said part and into said underlying highly porous layer at a position spaced from the crack or other void or from at least one of the cracks or other voids; closely fitting a flexible fluid-impermeable covering over the exposed surface, the covering having adjacent its boundary edges an endless hollow wall that surrounds and opens towards the covered surface; directly or indirectly sealing boundary edges of the covering to the structure to form a substantially fluid-tight enclosure incorporating the hollow wall; evacuating air and any other fluid from the hollow wall and from the or each extractor hole and introducing hardenable material in a liquid or semi-liquid state into the or each injector hole; as hardenable material appears at the outlet of the or each extractor hole, terminating evacuation of air and other fluid from this extractor hole and introducing hardenable material into the extractor hole; and, when hardenable material is being introduced into all injector and extractor holes, gradually bringing to a stop evacuation of air and other fluid as the hardenable material in said cracks and other voids sets.

Since the spread of hardenable material from the part of the structure under treatment to the underlying highly porous layer is controlled and confined by the air and other fluid being drawn from the surrounding part of the highly porous layer, the cracks and other voids in the part of the structure under treatment will be substantially filled with hardenable material.

Where a crack extends across the exposed surface of the structure, for example across a concrete road or airfield runway, preferably a plurality of extractor holes are drilled or otherwise formed at a plurality of spaced positions along the length of the crack. Preferably, also, two rows of mutually spaced injector holes are drilled or otherwise formed in said part of the structure, one row on one side of the crack and one row on the other side of the crack. At least one hollow wall that opens towards the covered surface and that is incorporated with the flexible fluid-impermeable covering may be positioned adjacent the row of extractor holes, air and other fluid also being evacuated from said hollow wall.

To facilitate introduction of hardenable material into the or each injector hole and the evacuation of air and other fluid from, and subsequent introduction of hardenable material into, the or each extractor hole, preferably a flexible tube of rubber or plastics material is inserted into and protrudes from each extractor and injector hole, each flexible tube preferably being fitted with a sealing gland to prevent leakage of hardenable material between the tube and the wall of the hole. Preferably, at least the or each flexible tube fitted into and protruding from an extractor hole is of transparent material to enable the hardenable material to be seen as it approaches the outlet of the extractor tube.

Where hardenable material is being drawn into the injector hole, or into one or more than one of the injector holes, at an undesirably high rate, a filler or fillers may be mixed with the hardenable material to render it less mobile and to reduce the risk of stress cracking when the hardenable material sets. The hardenable material is preferably a material that, when it sets, will adhere strongly to the boundary surfaces of the cracks and other voids. A material consisting of, or comprising as a major constituent, a synthetic resin being preferred.

The invention is further illustrated by a description, by way of example, of a preferred method of filling with a synthetic resin cracks and other voids in a concrete road overlying a highly porous sub-grade of clinker, with reference to the accompanying drawings, in which.

Figure 1:
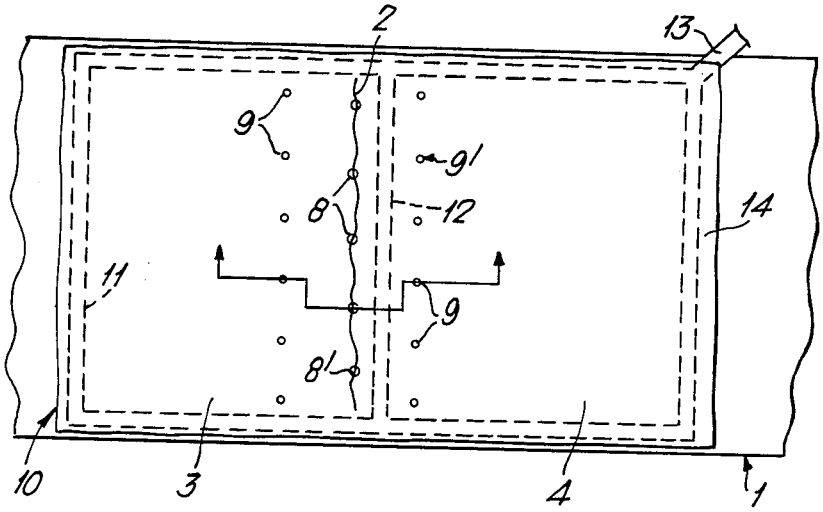
FIG. 1 is a diagrammatic plan view of the concrete road.
Figure 2:
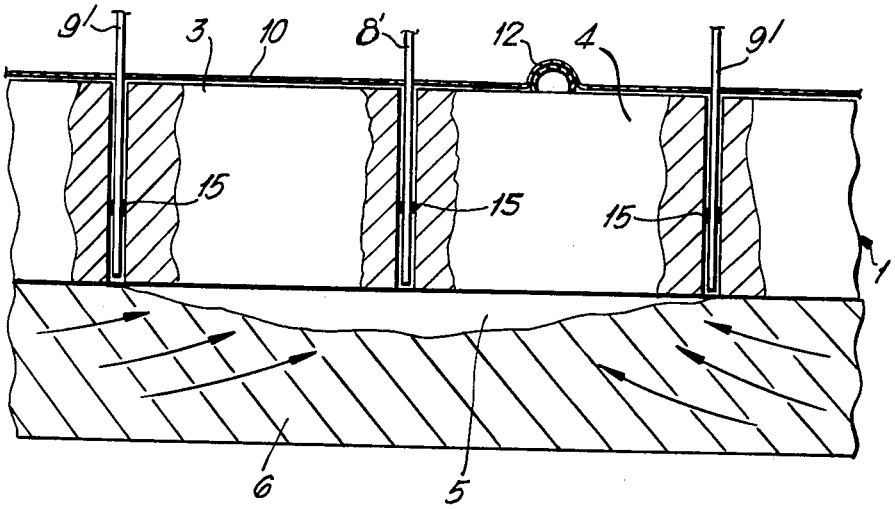
FIG. 2 is a fragmental cross-sectional view of the concrete road taken on the line II—II in FIG. 1.

Referring to FIGS. 1 and 2, a length 1 of concrete road has a crack 2 extending transversely across the road dividing the road into slabs 3 and 4, the road having cracked as a result of a void 5 that developed beneath the road between the road and an underlying highly porous layer 6 of clinker.

In order to fill the void 5 and crack 2 with a synthetic resin that will bond to the surfaces of the slabs 3 and 4, including those surfaces bounding the crack, a plurality of extractor holes 8 are drilled through the concrete at spaced positions along the length of the crack and two transversely extending rows of mutually spaced injector holes 9 are drilled on opposite sides of, and spaced from, the crack. Transparent plastics tubes 8' and 9' are inserted, respectively, into the extractor holes 8 and injector holes 9 and protrude from the holes, the tubes being sealed in the holes by glands 15. A flexible, fluid-impermeable polythene sheet 10 having adjacent its boundery edges an endless hollow wall 11 is applied on the part of the road under repair so that the endless hollow wall surrounds and opens towards the covered surface, the tubes 8' and 9' passing through holes in, and being sealed to, the polythene sheet. The endless hollow wall also includes a transversely extending hollow wall 12 which is positioned adjacent the row of extractor tube 8. Boundary edges of the polythene sheet 10 are sealed to the road by adhesive tape or mastic sealant 14.

Air and any other fluid is evacuated from the void 5, porous layer 6 and crack 2 through the extractor holes 8 and associated tubes 8' and from the hollow walls 11 and 12 through an outlet 13 and synthetic resin in a semi-liquid state is introduced into the injector holes 9 through the associated holes 9'. As synthetic resin appears in the associated tube 8' of each extractor hole 8, evacuation of air and other fluid from this hole is terminated and synthetic resin in a semi-liquid state is introduced into the hole. When synthetic resin is being introduced into all injector holes 9 and extractor holes 8, as the synthetic resin filling the void 5 and crack 2 sets, evacuation of air and other fluid through the outlet 13 is gradually brought to a stop. Since, during introduction of synthetic resin, the part of the road under repair is completely bounded by the evacuated hollow wall 11, 12, any air or other fluid leaking through cracks and voids in the road that extend under the polythene sheet 10 from beyond its boundary edges will enter the evacuated hollow wall from where such air and other fluid will be evacuated. The polythene sheet 10, hollow walls 11 and 12 and protruding parts of the tubes 8' and 9' are then removed, synthetic resin being applied in any depressions in the top of the holes 8 and 9 and the crack.

Since the synthetic resin, now setting, bonds to the surfaces of the concrete slabs 3 and 4, including the surfaces bonding the crack 2, the repaired part of the road 1 is at least as strong as the road itself.

Figure 3:
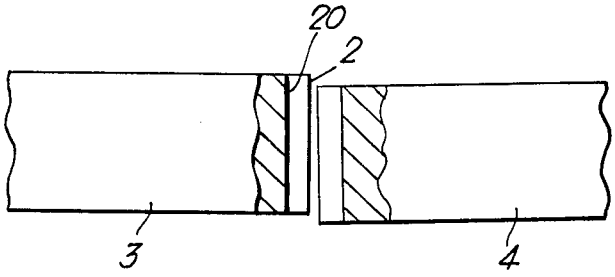
FIG. 3 is a fragmental cross-sectional view of a concrete road in which a part of the road has sunk, and FIGS. 4 and 5, respectively, are a side view and a fragmental view partly in section and partly in elevation illustrating a tool employed in raising the sunken part of the road before carrying out the method described with reference to FIGS. 1 and 2.
Figure 5:
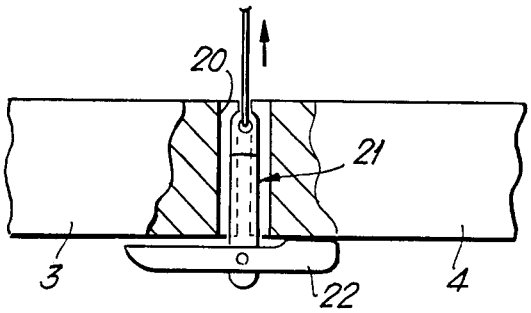
Figure 4:
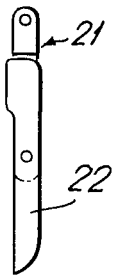

Where, as is shown diagrammatically in FIG. 3, the slab 4 has sunk so that its running surface is below the running surface of the slab 3, before the crack 2 is filled with synthetic resin, it is preferably to raise the sunken slab 4 so that 18 running surface is substantially level with that of the slab 3. Referring to FIGS. 4 and 5, this is done by drilling a plurality of holes 20 at spaced positions along the crack 2 and introducing into each hole an expendable claw 21 which is attached to a jack, winch or other lifting means and which has a pivotable arm 22, the arm being positioned to lie in the direction of introduction as the claw is introduced into the hole. After each claw 21 has been introduced into the hole 20, the arm 22 is caused to pivot and the claw is raised until the arm engages the undersurface of the sunken slab 4. The clamp 21 are then raised to lift the sunken slab 4 so that its running surface is substantially level with that of the slab 3 and to hold the slab 4 in this position whilst the filling operation described with reference to FIGS. 1 and 2 is carried out. As a final step, the lifting mechanism is detached from the claws which are left in the holes 20, any remaining void in these holes being topped up with synthetic resin.

What I claim as my invention is:

1. A method of introducing a hardenable material in a flowable state into voids in at least a part of an artificial or natural structure adjacent an exposed surface of the structure, which structure overlies a highly porous layer, which method comprises forming at least one extractor hole through said part and into said underlying highly porous layer in the vicinity of at least one void into which hardenable material is to be introduced; forming at least one injector hole through said part and into said underlying highly porous layer at a position spaced from the void; closely fitting a flexible fluid-impermeable covering over the exposed surface, the covering having adjacent its boundary edges an endless hollow wall that surrounds and opens towards the covered surface; sealing boundary edges of the covering to the structure to form a substantially fluid-tight enclosure incorporating the hollow wall; evacuating air and any other fluid from the hollow wall and from the extractor hole and introducing hardenable material in a flowable state into the injector hole; as hardenable material appears at the outlet of the extractor hole, terminating evacuation of air and other fluid from this extractor hole and introducing hardenable material into the extractor hole; and, when hardenable material is being introduced into all injector and extractor holes, gradually bringing to a stop evacuation of air and other fluid from the hollow wall as the hardenable material in said cracks and other voids sets.

2. A method as claimed in claim 1 in which a crack extends across the exposed surface of the structure, wherein a plurality of extractor holes are formed at a plurality of spaced positions along the length of the crack.

3. A method as claimed in claim 2, wherein two rows of mutually spaced injector holes are formed in said part of the structure, one row on one side of the crack and one row on the other side of the crack.

4. A method as claimed in claim 2 or 3, wherein the flexible fluid-impermeable covering incorporates at least one hollow wall that opens towards the covered surface and that is positioned adjacent the row of extractor holes, and air and any other fluid is evacuated from said hollow wall.

5. A method as claimed in claim 3, wherein the structure is a concrete road for supporting vehicles and other traffic.

6. A method as claimed in claim 5 in which the crack is of such a form that a concrete slab on one side of the crack has sunk below the level of the running surface of the concrete slab on the other side of the crack, wherein at least one lifting device is inserted into the crack, which device is caused to engage the undersurface of the sunken concrete slab, to raise the slab until the running surface of the slab is substantially level with that of the concrete slab on the other side of the crack, and to maintain the slab in this position until hardenable material has been introduced into all the voids.

7. A method as claimed in claim 6, wherein at least one lifting device is a claw having a pivotable arm, which claw is introduced into the crack with its arm extending in the direction of introduction and which arm can then be pivoted to engage the undersurface of the concrete slab.

8. A method as claimed in claim 1, wherein flexible tubes are inserted into and protrude from each extractor and injector hole.

9. A method as claimed in claim 8, wherein each of the flexible tubes is fitted with a sealing gland to prevent leakage of hardenable material between the tube and the wall of the hole.

10. A method as claimed in claim 8, wherein at least the or each flexible tube fitted into and protruding from an extractor hole is of transparent material.

* * * * *